US005167548A

United States Patent [19]

Thiger

[11] Patent Number: 5,167,548

[45] Date of Patent: Dec. 1, 1992

[54] TRIMMING SYSTEM FOR BOAT PROPULSION SYSTEM

[75] Inventor: Hans Thiger, Enhörna, Sweden

[73] Assignee: CPS Drive A/S, Sweden

[21] Appl. No.: 689,837

[22] PCT Filed: Oct. 25, 1989

[86] PCT No.: PCT/SE89/00591

§ 371 Date: May 28, 1991

§ 102(e) Date: May 28, 1991

[87] PCT Pub. No.: WO90/06255

PCT Pub. Date: Jun. 14, 1990

[30] Foreign Application Priority Data

Nov. 28, 1988 [SE] Sweden ..... 8804295-7

[51] Int. Cl.[5] ..... B63H 5/12

[52] U.S. Cl. ..... 440/60; 440/53; 440/58

[58] Field of Search ..... 440/53, 57, 58, 59, 440/60, 61, 111

[56] References Cited

U.S. PATENT DOCUMENTS 3,500,787 3/1970 Becker ..... 440/58
4,278,431 7/1981 Krautkremer et al. ..... 440/53
4,501,560 2/1985 Brandt et al. ..... 440/53
4,645,463 2/1987 Arneson ..... 440/57

FOREIGN PATENT DOCUMENTS 59548 5/1891 Fed. Rep. of Germany ..... 440/57

*Primary Examiner*—Sherman D. Basinger
*Assistant Examiner*—Thomas J. Brahan
*Attorney, Agent, or Firm*—Larson and Taylor

[57] ABSTRACT

A marine propulsion driving apparatus for an inboard engine of the type having an input drive shaft with a propeller shaft extending through the stern of the boat, with the body of the drive extending substantially straight out from the stern of the boat with a propeller at the outer end thereof. Both steering of the boat and vertical trimming of the drive body are brought about by operating the drive body itself, the drive body being mounted in a mounting ring at the stern of the boat. A trimming mechanism mounted relative to the mounting ring includes two cooperating inclined adjustment rings mounted in direct contact with each other. One of these adjustment rings carries the drive body and the two adjustment rings are rotatable relative to each other such that different inclination angle combinations are obtained and the drive body is thereby trimmed vertically.

10 Claims, 5 Drawing Sheets

TRIMMING SYSTEM FOR BOAT PROPULSION SYSTEM

FIELD OF THE INVENTION

The present invention generally relates to a marine propulsion system, generally referred to as a vessel or boat drive, for use in water vehicles having an inboard engine of the type in which the propeller shaft extends through the stern of the boat, substantially straight out from the rear end of the boat, and which propeller shaft has, at the outer end thereof, a propeller preferably of the surface water driving type, and in which apparatus both the steering of the boat and the trimming or tilting up and down respectively of the propeller is made by operating the body of the propulsion apparatus or boat drive.

BACKGROUND OF THE INVENTION

The invention is more particularly directed to a trimming system for a boat drive of the above mentioned type, by means of which the pitch angle of the drive body with the output propeller shaft can be controlled from between one or a few degrees above the horizontal plane to about 8–10 degrees below the horizontal plane, or preferably about +/− 5–8 degrees from a normal pitch angle of 3–6 degrees.

A boat drive of this type is known from U.S. Pat. No. 4,645,463 (H M Arneson) which patent discloses a structure in which the drive body is formed with a ball over which the drive is connected to a part of the inboard engine, in that said ball is journalled in a ball carrier which is mounted at the stern of the boat, whereby the drive can be rotated universally, and which drive is formed with at least one hydraulic cylinder for trimming the drive up and down, and at least two further hydraulic cylinders for rotating the drive in the horizontal plane when turning the boat left or right.

A boat drive of this type having a water surface driving propeller is advantageous as compared with the so called Z-drive (inboard-outboard) type, and above all the drive is subjected to less flow losses and less power losses than boat drives having angle gears and transmission gear sets. Depending on the simple structure of the drive it is also cheaper, more effective and apt to less wear and has less sources of errors than many other types of boat propulsion drives or gears.

The apparatus known from U.S. Pat. No. 4,645,463 indeed involves the advantages of a drive being a straight, surface water driving propulsion drive, but it is disadvantageous in that the ball and the ball carrier are subjected to strong stresses; in that certain plays may appear in the steering means thereof; in that the hydraulic cylinders for the trimming (tilting) and for the steering operations need to be serviced and maintained, are subjected to wear and are sensitive to ruptures and leakage in the hydraulic conduits; and in that there is a need for long conduits and/or hoses from the propulsion drive at the outside of the boat to the maneuvre place inside the vessel or boat.

Normally surface driving propellers have a bad back driving capacity and this also in a disadvantage of the above mentioned apparatus.

SUMMARY OF THE INVENTION

Therefore, the object of the present invention is to suggest a propulsion drive or gear for an inboard-outboard motor of the type in which the drive has a surface driving propeller which extends through the stern of the boat and substantially straight back therefrom, and in which the propulsion drive is formed so that it is possible to trim (tilt) the drive body with the propeller up and down without using hydraulic cylinder hoses provided at the outside of the boat, so that the steering can be made by means of hydraulic cylinders or equivalent axial motors provided inboard the boat, in which the propulsion drive has no actuation means at all provided on the exterior side of the boat for trimming the drive and for steering the boat, in which both the trimming and the steering is made by means of actuation means placed inside the complete drive structure and at the interior side of the boat or vessel hull, and which has an improved back driving ability as compared with previously known systems of the same general type.

BRIEF DESCRIPTION OF THE DRAWINGS

Further characteristics and advantages of the invention will be evident from the following detailed description in which reference will be made to the accompanying drawings.

In the drawings

DETAILED DESCRIPTION OF THE PREFERRED EMBODIMENTS

Figure 1:
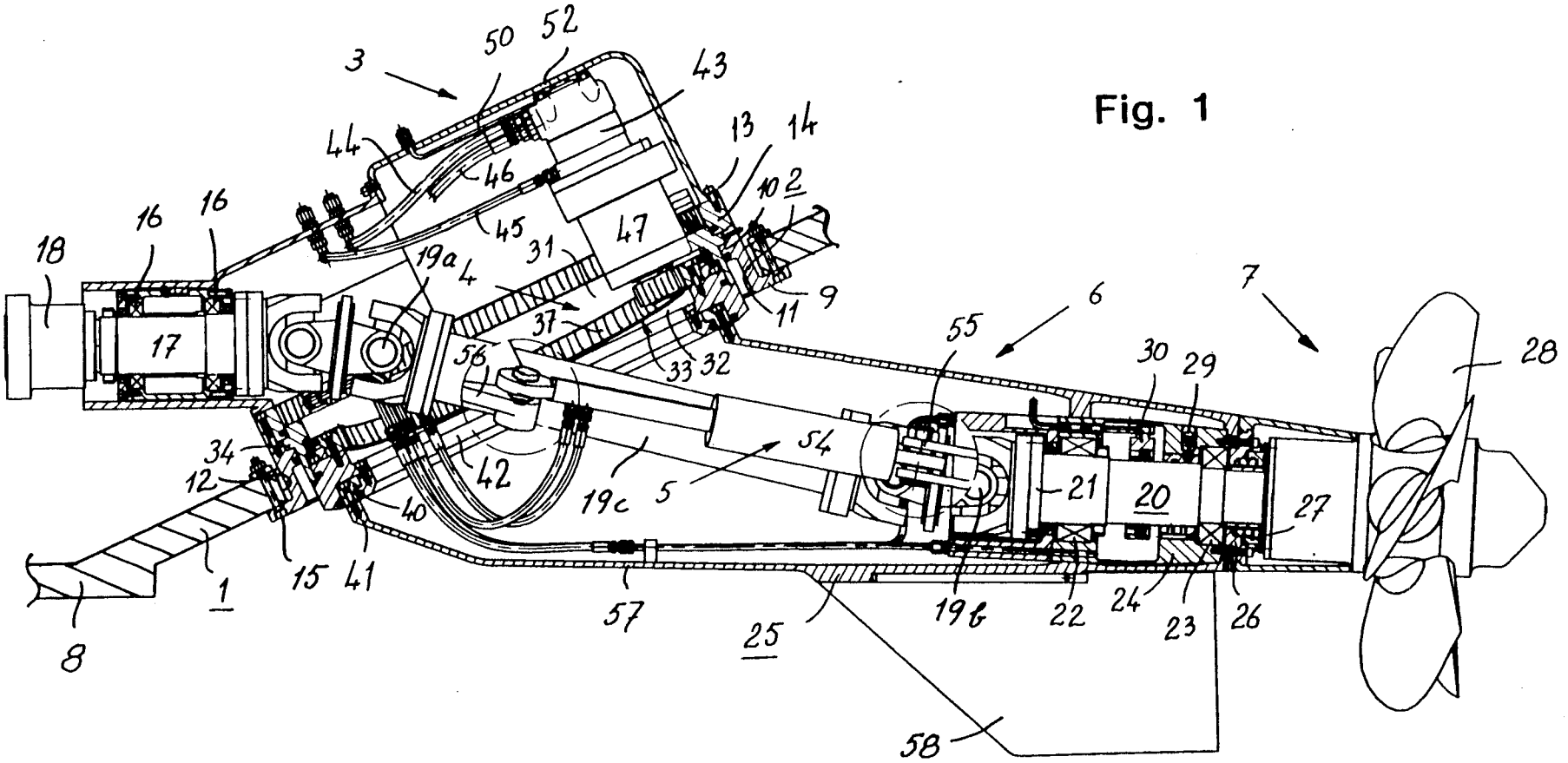
FIG. 1 is a side view in a vertical cross section of an embodiment of a propulsion drive according to the invention.

For the sake of clarity the inboard boat engine has been omitted, but it should be noted that the engine may be directly or indirectly connected to the actual propulsion drive, and that drive coupling between the drive engine and the propulsion drive may be be of any known type and does not influence the invention.

As conventional, the propulsion drive according to the invention extends through the stern 1 of a boat or a vessel and is mounted on said stern by means of a mounting ring 2. The drive generally comprises a mounting or bearing body 3 provided at the interior side of the boat hull, a trimming or tilting mechanism 4, a steering mechanism 5, a drive body 6 and a propeller mechanism 7.

The drive is mounted close to the bottom 8 of the boat. The boat should be of the fast running and preferably planing type. For obtaining the best function of the invention the stern should be rather long, sloping rearwardly, for instance sloping at an angle of between 20° and 40°, or preferably between 22° and 30°. In the case illustrated in the drawings the stern has a pitch angle of 25° to the horizontal plane. Because of the unusually long sloping stern there is obtained, when adjusting the propellers for rearward driving, a forwardly directed flow of water which smoothly follows the shape of the stern rather than being thrown against the stern, which would in turn reduce the back driving capacity, such as is usual for boats having a relatively vertically extending stern. Therefore the apparatus of the invention has an improved back driving capacity.

The mounting ring 2 is formed with a radially outwardly extending outer flange 9 and a radially inwardly extending inner flange 10 and with a sleeve portion 11 between said flanges. The outer flange 9 is adapted to be mounted on the exterior side of the stern 1, and the inner flange 10 with the sleeve portion 11 is adapted to carry the entire drive body 6.

When mounting the drive on the stern a bore, preferably a circular bore 12, is cut out of the stern 1, and into said bore the mounting ring 2 is introduced with the flange 9 thereof in contact with the outer surface of the stern around said bore 12. On the inner side of the stern there are several screw-nut connetion means, and an all around extending flange 13 of the bearing body 3 is over a connection ring 14 connected to the mounting ring 2, and the entire structure is screwed to the stern under water sealed conditions by means of bolts 15.

The bearing body 3 is formed as a closed, water sealed casing which, over a double ball bearing 16 and an intermediate slide box 17 for the input drive shaft 18 is connected to an inboard engine (not illustrated). The end of the input drive shaft 18 is formed with an intermediate drive shaft comprising two spaced universal joints 19*a* and 19*b* and an intermediate sleeve 19*c*, which intermediate drive shaft 19*a–c* gives a constant angle speed and eliminates un-even torque and thrust in the transmission joints. The ball bearing/slide coupling 16–17 which is of known type, allows an axial movement of the combined drive coupling.

Figure 2A:
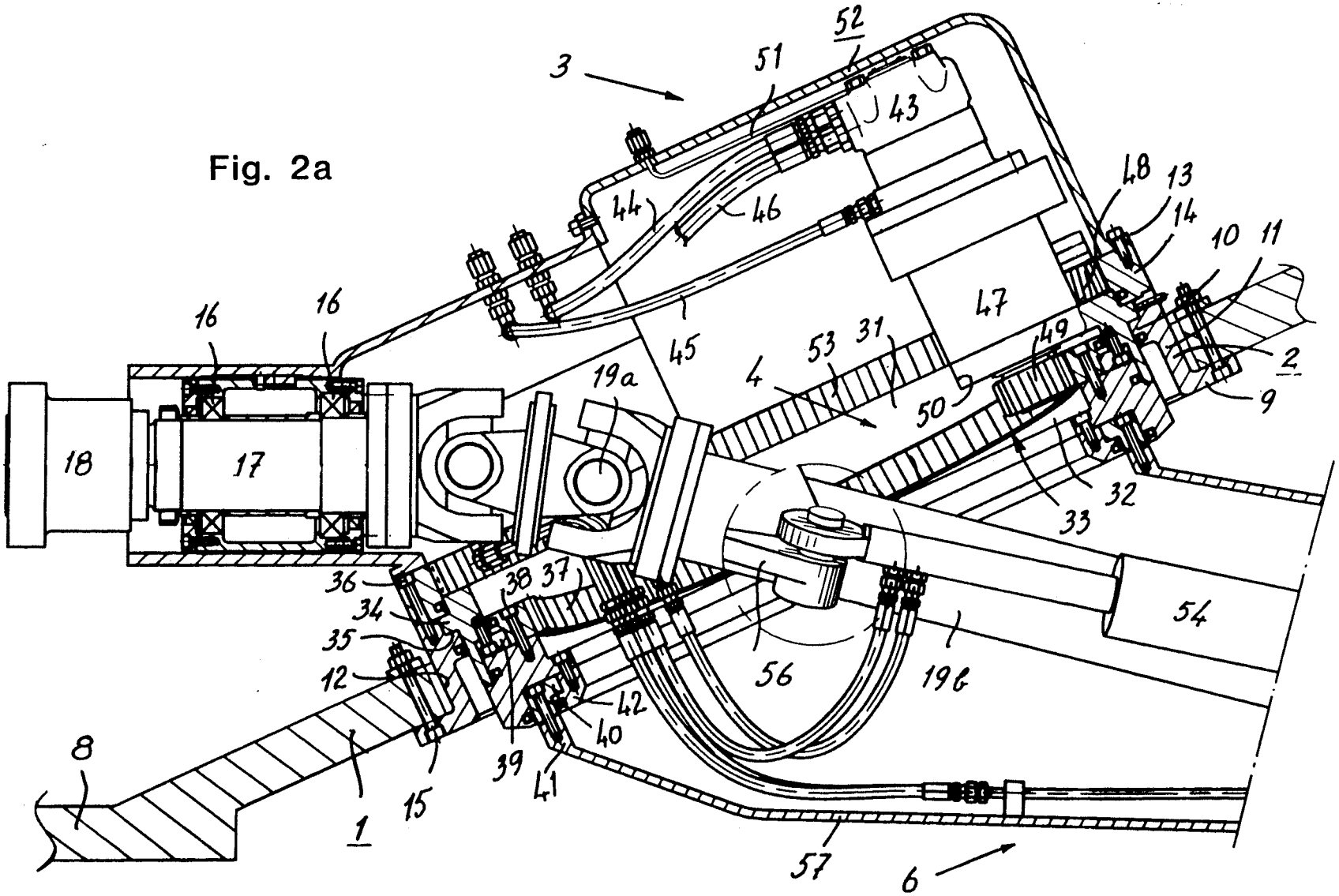
FIGS. 2*a* and 2*b* are in combination an enlarged view of FIG. 1.
Figure 2B:
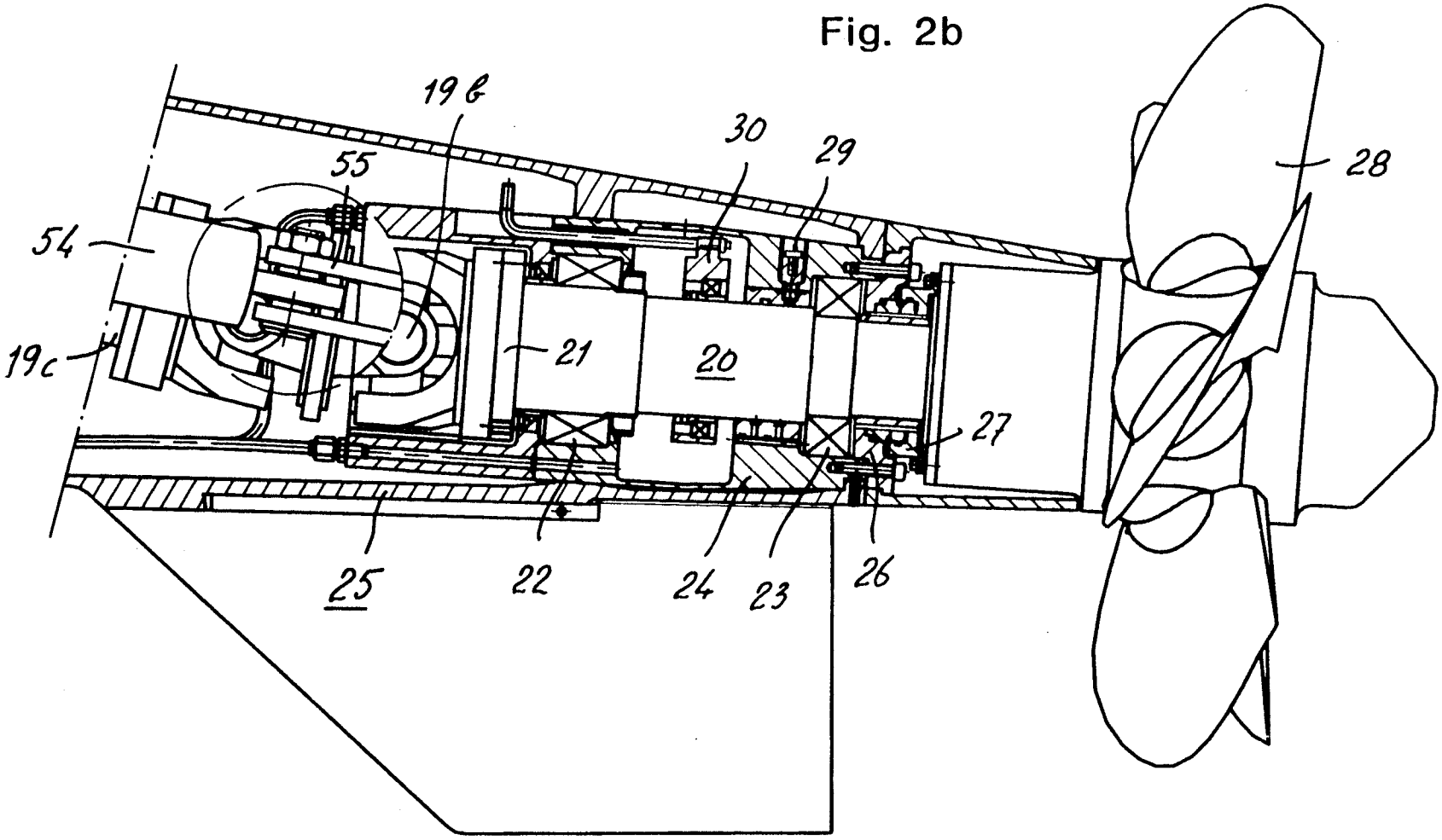

As best seen from FIG. 2*b* a propeller shaft 20 is connected to the output end of the rear universal Joint 19*b* by a flange 21 thereof. The propeller shaft 20 is journalled in the drive body 6 over two spaced roller bearings 22 and 23, which roller bearings 22 and 23 are mounted in a bearing sleeve 24 which in turn is fixedly mounted at the end of the drive body housing 25 via a screw connected locking ring 26, such that the propeller shaft 20 can take pressure forces, both in the forward and rearward direction. A seal 27 at the end of the propeller shaft 20 prevents water from entering the drive body 6. The propeller mechanism 7 is of known type and is therefore not to be described in detail. The propeller or the propellers preferably are formed with propeller blades 28 which can be adjusted to various angles so that said propeller blades, by being angle-adjusted, can provide a forward or a rearward propulsion or an idle drive position. The adjustment of the propeller blades is made by means hydraulic pressure fluid entering the propeller shaft 20 and passageways (not illustrated) in the propeller shaft through one or more hydraulic valves 29. The set position of the propeller blades is tranferred to the maneuvre place by means of an indicator 30.

The trim mechanism 4 and the steering mechanism 5 are formed as an integral unit which is connected between the mounting body and the drive body. The trim mechanism is connected to the mounting ring 2 by means of the connection ring 14.

Referring in particular to FIG. 2*a* the trim mechanism 4 generally comprises two co-operating adjustment rings, referred to below as the inner adjustment ring 31 and the outer adjustment ring 32. The surfaces 33 of said rings 31, 32 facing each other are inclined. In the illustrated case the two adjustment rings have an inclination angle of about 10°, whereby the drive body 6 is adapted for being tilted or trimmed 10° up, see FIG. 4, or 10° down, see FIG. 5, from a neutral position, FIG. 3, but it is obvious that the inclination may be varied with respect to the desired capability of "trimming" the drive up and down, resp. The two adjustment rings 31 and 32 are rotatable in relation to each other and in relation both to the mounting ring 2 and to the drive body 6. The adjustment rings 31 and 32 are mounted so that, in the neutral positions of the rings, the thinnest and the thickest ring parts, resp. are in contact with each other. The inner ring 31 is formed with a radially outwardly extending collar 34 by means of which it is rotatably clamped between the connection ring 14 and a collar 35 of the mounting ring 2, and for the purpose the connection ring 14 is screw connected at 36 to the mounting ring 2. At the top of the second ring 32 an inner rack ring 37 is screw connected at 38 and the second ring 32 with the rack ring 37 is rotatably clamped to the first or inner ring 31 by means of a locking ring 39. A guide ring 40 is rotatably mounted in a recess at the bottom surface of the second ring 32 and said guide ring is screw connected to the end surface 41 of the drive body 6. The guide ring 40 with the drive body 6 is rotatably clamped to the second ring 32 by means of a locking ring 42 which is screw connected to the second ring 32.

Thus the inner ring 31 is rotatable in relation to the connection ring 2 with the mounting ring 14 and to the second ring 32; said second ring 32 with the rack ring 37 is rotatable in relation to the first ring 31 and the mounting ring 2; and the drive body 6 with the guide ring 40 is rotatable in relation to the outer or second ring 32.

The trimming of the drive body up or down is made by rotating the two adjustment rings 31 and 32 in opposite directions. To this end the apparatus is formed with a hydraulic motor 43 which is supplied with pressure fluid by conduits 44 and 45 and is drained by another conduit 46. The hydraulic motor is formed with a gear box 47 having a first and a second gear 48 and 49. The hydraulic motor 43 with the gear box 47 is mounted in a recess 50 in the first ring 31 for rotation in common with said first ring 31. The motor 43 is maintained at a fixed radius by a rotation rod 51 which is mounted at the top of the housing 52 of the mounting body 3 concentrically with the rings 31 and 32.

The connection ring 14 is formed with an inner ring formed rack 53, which rack is consequently stationarily mounted in relation to the mounting body 3. The gear 48 cooperates with the stationary inner ring rack 53, and by actuating the hydraulic motor 43 and thereby rotating the gear 48 the motor with the gear box 47 rotates in one direction or the other on the stationary inner rack 53. Thereby also the first or inner ring 31 is rotated together with the motor 43. The gear 49 of the hydraulic motor 43 cooperates with the inner gear 37 of the second ring 32 and it is arranged to rotate the second ring 32 in a direction which is opposite to the movement of the first ring 31 and at a speed which is the same as the speed of the first ring 31. This means that the gear 49 rotates at twice the speed of the gear 48.

Figure 3:
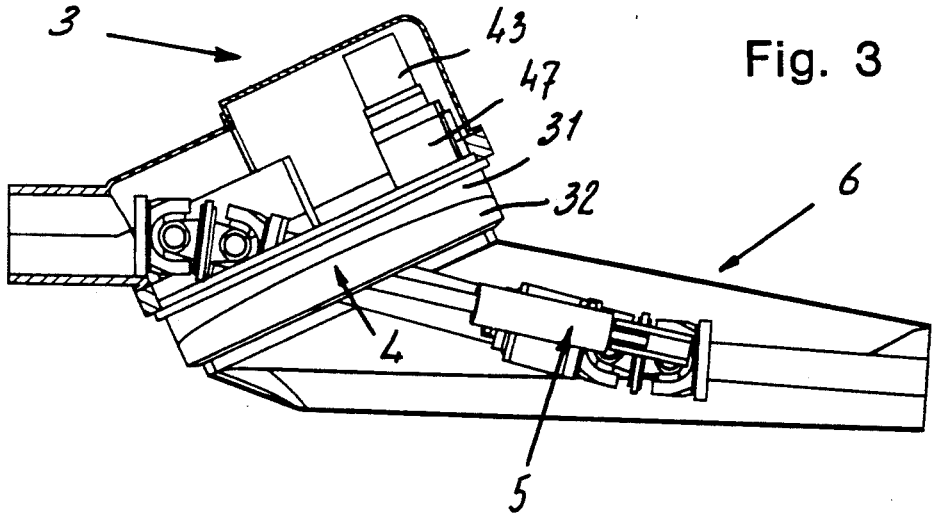
FIG. 3 is a fragmentary side view of a drive according to the invention in its normal trim position.
Figure 4:
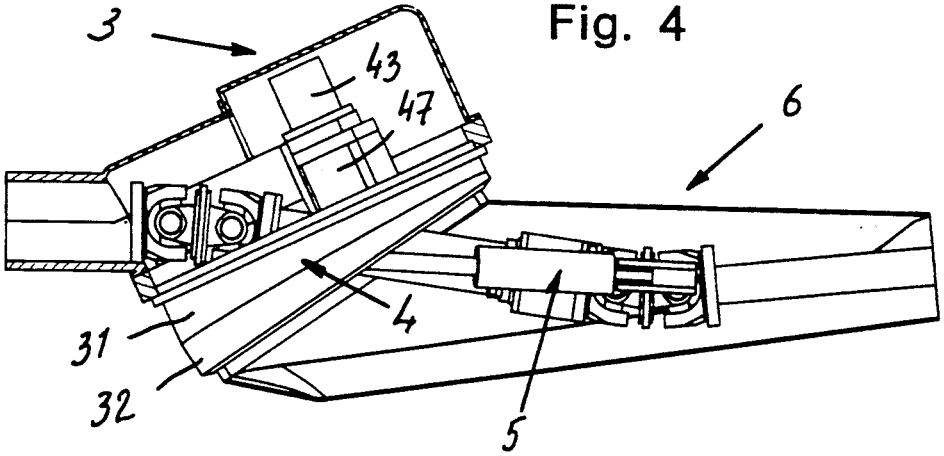
FIG. 4 is view similar to that of FIG. 3 showing the drive trimmed up a maximum angle and FIG. 5 similarly shows the drive trimmed down a maximum angle.
Figure 5:
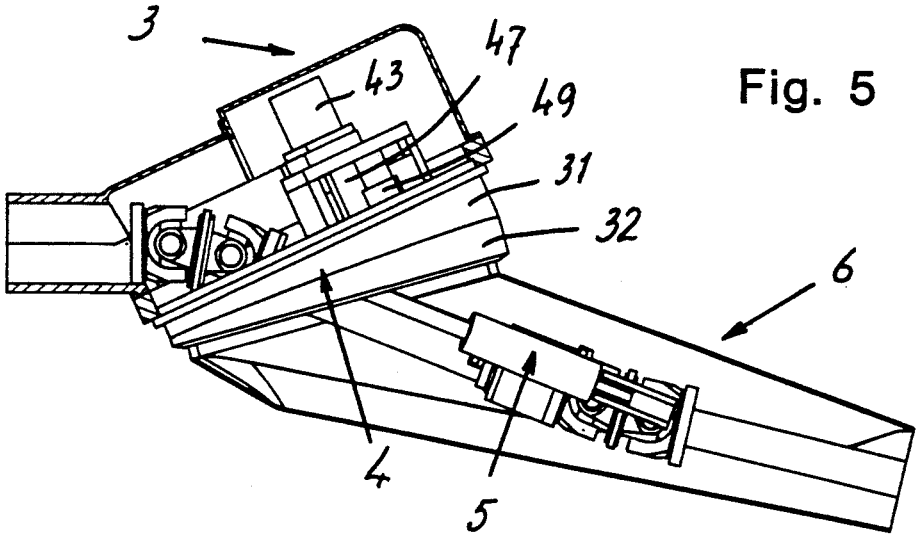
Figure 6:
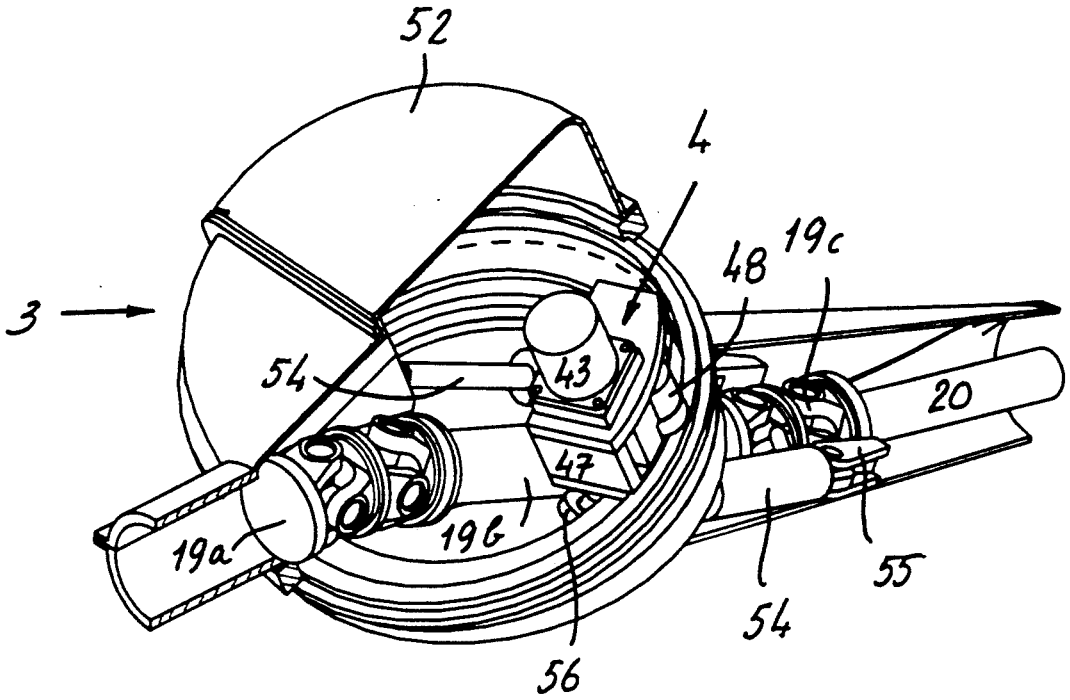
FIG. 6 is a fragmentary perspective view of a part of the drive showing the trimming motor and the mounting of the steering cylinders.
Figure 7:
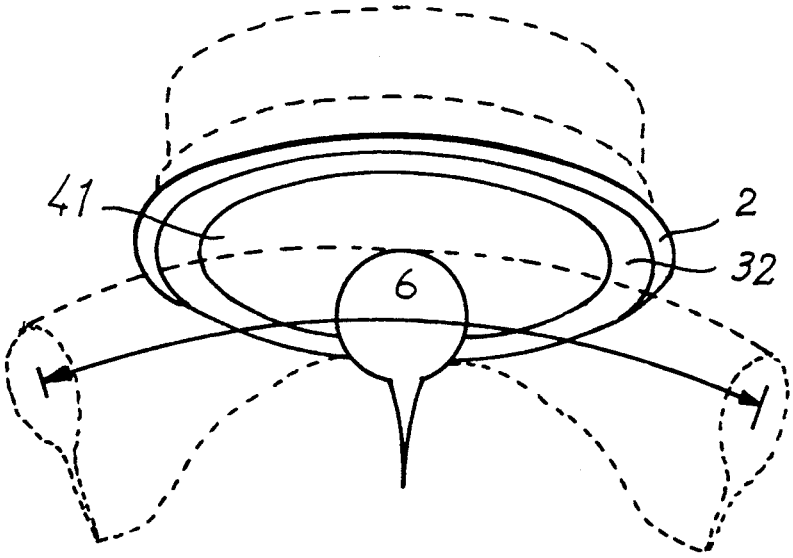
FIG. 7 is a diagrammatical rear view of the drive according to the invention showing the movement of the propeller or propellers when turning the boat in one direction or the other.

By actuating the hydraulic motor 43 the gear 48 rotates the motor 43 and thereby the first or inner ring 31 in one direction or the other in relation to the mounting body 3 with the inner rack 53, and concurrently therewith the gear 49 rotates the second ring 32 in the opposite direction whereby different adjustment ring combinations are obtained. FIG. 3 shows the apparatus in a neutral position, whereby the motor 43 is located at the top end of the mounting body 3 and the thickest and thinnest portions of the rings 31 and 32, resp. contact each other. By rotating the rings 31 and 32 in one (counter clockwise direction as seen from inside the boat) as illustrated in FIG. 4 of the drawings the thickest portions of the two cone rings 31 and 32 contact each other at the bottom portion of the mounting body 3 and the thinnest portions of the two rings 31 and 32 contact each other at the top end of the mounting body 3, and in this case the drive body is trimmed maximum upwards, in the illustrated case at an angle of 10° from the neutral position. FIG. 5 illustrates the apparatus after the hydraulic motor 43 is operated in the opposite direction (the clockwise direction as seen from inside the boat) whereby the drive body is tilted maximum downwards, in the illustrated case 10° downwards.

The end face 41 of the drive body 6 is circular and said end of the drive body is rotatably connected in a groove of the second ring 32 of the trimming mechanism 4. For rotating the drive body 6 in relation to the mounting body, thereby turning the boat in the starboard or port direction, there is a hydraulic cylinder 54 inside the drive body 6 on each side of the sleeve **19*c* and the propeller shaft 20. The hydraulic cylinders 54 are mounted with the cylinder part thereof at an ear 55 which is fixedly connected to the bearing sleeve 24 and with the piston rod part thereof at an ear 56 which is fixedly mounted at the mounting body housing 52**.

Since the hydraulic cylinders 54 extend at a specific angle to the slide surface between the drive body end 41 and the second ring 32 an actuation of the hydraulic cylinders introduces a rotary force between the drive body 6 and the mounting body, 3 which force causes the drive body to rotate with the end 41 thereof in the slide groove of the second ring 32, and thereby in relation to the mounting body 3.

Since the mounting body 3 is designed so as to form a certain angle to the vertical plane the propeller or propellers at the outer end of the drive body 6 is/are caused to make a double movement upon a steering function, namely both a rotation in the horizontal plane, causing the boat to turn, and also a dipping of the propeller(s) in the vertical direction, said double movement resulting in a tendency of the boat to turn vertically inwardly to the turning center, just as happens upon turning with a bicycle. Said turn-over movement inwardly to the turning center is a valuable function which both contributes to a stabilizing of the boat and also eliminates the feeling of discomfort which will otherwise appear, something that is especially noted at catamarans, hydrofoil boats, boats having a high center of gravity, etc.

Normally the propulsion drive takes a predetermined horizontal driving position which is, in the illustrated case, at an angle to the horizontal plane of for instance four degrees, at which position the flow of water from the bottom 8 of the boat and past the bottom side 57 of the drive body 6 and also the other parts of the drive is fully laminar. Therefore there are practically no flow losses, not even at high speeds. Considering the load and speed etc. of the boat, or by driving the boat on shallow water it may be desired to trim the drive up (or down) and this is done by rotating the tilt drive motor 43 whereby the racks 53 and 37 provide a rotation of the inner and outer adjustment rings 31 and 32 in opposite directions so that the inclined surfaces of said rings take a changed mutual position, whereby the drive is successively tilted up or down (compare FIGS. 3–5) depending on what direction the motor 43 is rotated. This change of trim position can very well be made while running the boat and it is made without any influence at all on the steering function.

The steering is made solely by rotating the drive end or guide head 40, 41 by actuating the steering cylinders 54, whereby the drive body 6 is both rotated in the horizontal direction and is dipped successively downwards in the vertical direction in relation to the mounting body and the stern of the boat. Thereby the boat is both turned in the desired direction and is inclined in the direction towards the center of turning the boat.

As seen from the drawings a steering fin 58 preferably can be mounted at the bottom 57 of the drive body 6.

| Reference numerals | |
|---|---|
| 1 | stern |
| 2 | mounting ring |
| 3 | mounting body |
| 4 | trimming mechanism |
| 5 | steering mechanism |
| 6 | drive body |
| 7 | propeller mechanism |
| 8 | bottom (of boat) |
| 9 | outer flange (of 2) |
| 10 | inner flange (of 2) |
| 11 | sleeve portion (of 2) |
| 12 | bore (of 1) |
| 13 | flange (of 3) |
| 14 | connection ring |
| 15 | bolt |
| 16 | ball bearing |
| 17 | slide box |
| 18 | input shaft |
| 19a | universal joint |
| 19b | universal joint |
| 19c | sleeve |
| 20 | propeller shaft |
| 21 | flange |
| 22 | roller bearing |
| 23 | roller bearing |
| 24 | bearing sleeve |
| 25 | drive body housing |
| 26 | locking ring |
| 27 | seal |
| 28 | propeller blade |
| 29 | hydraulic valve |
| 30 | indicator |
| 31 | inner adjustment ring |
| 32 | outer adjustment ring |
| 33 | cone surface |
| 34 | collar |
| 35 | collar |
| 36 | screw |
| 37 | inner rack ring (of 32) |
| 38 | screw |
| 39 | locking ring |
| 40 | guide ring |
| 41 | end surface, guide ring |
| 42 | locking ring |
| 43 | hydraulic motor |
| 44 | conduit |
| 45 | conduit |
| 46 | drain conduit |
| 47 | gear box |
| 48 | gear |
| 49 | gear |
| 50 | recess |
| 51 | rotation rod |

-continued

| Reference numerals | |
|---|---|
| 52 | housing (3) |
| 53 | inner rack ring |
| 54 | hydraulic cylinder |
| 55 | ear (at 24) |
| 56 | ear (at 3) |
| 57 | bottom (of 6) |
| 58 | steering fin |

I claim:

1. A marine propulsion drive apparatus for an inboard engine, comprising:

a drive body having an input drive shaft with a propeller shaft journalled thereto, said drive body extending through the stern of a boat, substantially straight back from said stern, with a propeller of the surface water driving type at its outer end, a trimming mechanism for trimming of the drive body, by operating the drive body itself, the drive body being rotatably mounted in a mounting ring at the stern of the boat, the trimming mechanism mounted in a trimming ring at the stern of the boat, said trimming mechanism comprising two cooperating superimposed adjustment rings having inclined surface which are in direct contact with each other, one adjustment ring carrying the drive body, and wherein the two adjustment rings are rotatable in relation to each other, such that upon rotation of said adjustment rings, different inclination ring combinations are obtained and the drive body is thereby trimmed upwardly or downwardly, respectively.

2. An apparatus according to claim 1, including an inner adjustment ring and an outer adjustment ring, the inner adjustment ring being mounted in a main mounting ring of the apparatus and the outer adjustment ring being mounted in the inner adjustment ring.

3. An apparatus according to claim 2, wherein the two adjustment rings are rotatable, in relation to each other and in relation to said mounting ring, and wherein the outer of the two adjustment rings carries the drive body.

4. An apparatus according to claim 3, including a mounting body mounted at the stern of the boat, the mounting body being formed with a stationary inner rack ring, the inner adjustment ring carrying an adjustment motor, the outer adjustment ring being formed with an inner rack ring, a first gear of the adjustment motor engaging the stationary inner rack ring and a second gear of the adjustment motor engaging the rack ring of the outer adjustment ring.

5. An apparatus according to claim 4, wherein the said adjustment gears are arranged to rotate in opposite directions upon actuation of the adjustment motor, the adjustment gear which engages the rack ring of the outer adjustment ring having double the rotational speed of the gear which engages the stationary inner rack ring.

6. An apparatus according to claim 1, wherein the inclined rings include an inner adjustment ring and an outer adjustment ring, the inner adjustment ring being rotatably connected to a collar of the mounting ring.

7. An apparatus according to claim 1, wherein the drive body and stern of the boat have a common mounting angle of 20° to 40° relative to a horizontal plane.

8. An apparatus according to claim 1, wherein the drive body is mounted such that a shaft of the propeller, when the boat is running, extends at an angle of 3° to 6° relative to the horizontal, and wherein the drive body can be trimmed upwardly or downwardly over a maximum angle of approximately 10° relative to a normal operating angle.

9. An apparatus according to claim 1, in which the trimming mechanism is enclosed in a mounting body fixedly mounted at the interior side of the stern of the boat, and including a coupling between an input drive shaft and a propeller shaft, which coupling comprises a ball and is in series with two universal joints and an intermediate sleeve.

10. An apparatus according to claim 1, wherein the adjustment rings include an inner adjustment ring and an outer adjustment ring, a hydraulic trimming motor combined with a gear box, and wherein the trimming motor with the gear box is rotatable together with the outer adjustment ring and is guided by a rotation rod mounted in the mounting body concentrically with the adjustment rings.

* * * * *